US012104325B2

(12) United States Patent
Zhang et al.

(10) Patent No.: US 12,104,325 B2
(45) Date of Patent: Oct. 1, 2024

(54) PREPARATION METHOD OF HEAT-NOT-BURN CIGARETTE PAPER WITH BORON NITRIDE AS THERMALLY-CONDUCTIVE FILLER

(71) Applicant: ZHEJIANG UNIVERSITY, Hangzhou (CN)

(72) Inventors: Qinghua Zhang, Hangzhou (CN); Hongyu Guo, Hangzhou (CN); Xiaoli Zhan, Hangzhou (CN); Fengqiu Chen, Hangzhou (CN); Dangguo Cheng, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 294 days.

(21) Appl. No.: 17/796,280

(22) PCT Filed: Oct. 13, 2021

(86) PCT No.: PCT/CN2021/123491

§ 371 (c)(1),
(2) Date: Jul. 29, 2022

(87) PCT Pub. No.: WO2022/217870

PCT Pub. Date: Oct. 20, 2022

(65) Prior Publication Data

US 2023/0265615 A1 Aug. 24, 2023

(30) Foreign Application Priority Data

Apr. 14, 2021 (CN) ..... 202110402704.1

(51) Int. Cl.

| | |
|---|---|
| ***D21H 21/34*** | (2006.01) |
| ***A24C 5/00*** | (2020.01) |
| ***A24D 1/02*** | (2006.01) |
| ***D21H 17/00*** | (2006.01) |
| ***D21H 17/14*** | (2006.01) |
| ***D21H 17/36*** | (2006.01) |
| ***D21H 17/67*** | (2006.01) |
| ***D21H 19/20*** | (2006.01) |
| ***D21H 21/16*** | (2006.01) |
| ***D21H 23/04*** | (2006.01) |
| ***D21H 23/56*** | (2006.01) |

(52) U.S. Cl.

CPC ..... *D21H 21/34* (2013.01); *A24C 5/005* (2013.01); *A24D 1/02* (2013.01); *D21H 17/14* (2013.01); *D21H 17/36* (2013.01); *D21H 17/675* (2013.01); *D21H 17/74* (2013.01); *D21H 19/20* (2013.01); *D21H 21/16* (2013.01); *D21H 23/04* (2013.01); *D21H 23/56* (2013.01)

(58) Field of Classification Search

CPC ..... D21H 21/34; D21H 17/14; D21H 17/36; D21H 17/675; D21H 17/74; D21H 19/20; D21H 21/16; D21H 23/04; D21H 23/56; A24C 5/005; A24D 1/02

See application file for complete search history.

(56) References Cited

U.S. PATENT DOCUMENTS

| | | | | |
|---|---|---|---|---|
| 5,849,153 | A | 12/1998 | Ishino et al. | |
| 2018/0291561 | A1* | 10/2018 | Kitagawa | D21H 21/54 |
| 2021/0045433 | A1* | 2/2021 | Osawa | A24F 40/46 |

FOREIGN PATENT DOCUMENTS

| | | | | |
|---|---|---|---|---|
| CN | 109680540 A | * | 4/2019 | D21H 11/12 |
| CN | 110629583 A | | 12/2019 | |
| CN | 111549562 A | | 8/2020 | |
| CN | 113152145 A | | 7/2021 | |

* cited by examiner

*Primary Examiner* — Jacob T Minskey
*Assistant Examiner* — Stephen M Russell
(74) *Attorney, Agent, or Firm* — Bayramoglu Law Offices LLC

(57) ABSTRACT

A preparation method of a heat-not-burn cigarette paper with boron nitride as a thermally-conductive filler includes: mixing potassium oleate, polyvinyl alcohol (PVA) and water, thoroughly stirring under an ultrasonic condition, aging, and filtering until there is no precipitate; thoroughly mixing a resulting mixed solution with a softwood pulp and a hardwood pulp to obtain a coarse pulp; and under stirring, adding boron nitride and calcium carbonate as a filler to the coarse pulp, heating to 60° C., and stirring for thorough mixing to obtain a pulp for sizing and papermaking. The present disclosure effectively improves the stability of a cigarette paper by improving a coefficient of thermal conductivity of the paper. Boron nitride, when used as a thermally-conductive filler in a thin-walled or paper product, enables high heat removal capacity. The preparation method retains the original whiteness and transparency of the cigarette paper, and provides high conductivity.

5 Claims, No Drawings

PREPARATION METHOD OF HEAT-NOT-BURN CIGARETTE PAPER WITH BORON NITRIDE AS THERMALLY-CONDUCTIVE FILLER

CROSS REFERENCE TO THE RELATED APPLICATIONS

This application is the national phase entry of International Application No. PCT/CN2021/123491, filed on Oct. 13, 2021, which is based upon and claims priority to Chinese Patent Application No. 202110402704.1, filed on Apr. 14, 2021, the entire contents of which are incorporated herein by reference.

TECHNICAL FIELD

The present disclosure belongs to the technical field of cigarette paper manufacturing, and in particular relates to a preparation method of a heat-not-burn cigarette paper with boron nitride as a thermally-conductive filler.

BACKGROUND

A smoking temperature of a traditional cigarette is as high as 900° C., and many harmful substances are produced during the combustion and pyrolysis of a tobacco leaf or a tobacco material at a high temperature. Low-tar and low-hazard cigarettes are the trend of cigarette development, and heat-not-burn (HnB) cigarette products are new tobacco products in which a cigarette wick mainly composed of shredded tobacco only gets hot and does not burn when heated by a specific heat source (below 500° C.). In this technology, a temperature is generally controlled at 350° C. or lower by baking a specially-made "smoke bomb" with a heater, such that nicotine and aromatic substances in a tobacco can be released. In this way, the production of a large number of toxic and harmful substances due to tobacco combustion is avoided, while a taste of a tobacco can be retained. Therefore, HnB cigarette products are very suitable for smokers to use instead of traditional cigarettes by bringing some tobacco characteristic feelings to consumers, reducing the hazard of tobaccos.

When an ordinary cigarette paper is baked, the thermal conductivity is low, which is not conducive to the release of nicotine and aromatic substances in a cigarette wick. In addition, the instability at high temperature may lead to the release of other odors, affecting a taste of a cigarette.

SUMMARY

Technical problem to be solved by the present disclosure: In order to overcome the deficiencies of the prior art, a heat-not-burn cigarette paper with boron nitride as a thermally-conductive filler and a preparation method thereof are provided. The cigarette paper has high thermal conductivity and prominent flame-retardant stability at high temperature, and a color of the cigarette paper remains basically unchanged at high temperature.

To solve the technical problem, the present disclosure adopts the following technical solution:

A preparation method of a heat-not-burn cigarette paper with boron nitride as a thermally-conductive filler is provided, including a conventional cigarette paper making process of preparation of a coarse pulp, milling with a filler, sizing and papermaking, pre-drying, surface coating, post-drying, and calendering to obtain a paper, where pulp preparation specifically includes:

(1) preparation of a coarse pulp mixing 0.05 to 0.1 part by weight of potassium oleate, 0.1 to 0.2 part by weight of polyvinyl alcohol (PVA), and 5 parts by weight of water, thoroughly stirring for 30 min under an ultrasonic condition, aging for 2 hours, and filtering until there is no precipitate; and thoroughly mixing a resulting mixed solution with 15 to 25 parts by weight of a softwood pulp and 50 to 70 parts by weight of a hardwood pulp to obtain the coarse pulp;

(2) milling with a filler under stirring, adding 1 to 15 parts by weight of boron nitride and 20 to 50 parts by weight of calcium carbonate as a filler to the coarse pulp, heating to 60° C., and stirring for thorough mixing to obtain a pulp for the sizing and papermaking.

In the present disclosure, the surface coating may refer to coating 1 to 3 parts by weight of polyacrylamide (PAM as an additive on a surface of a cigarette paper by roller coating using a coating machine.

In the present disclosure, the PVA may have a molecular weight ranging from 200 to 3000.

In the present disclosure, the boron nitride particles may have an average particle size of 12 μm to 16 μm.

The present disclosure further provides a pulp including boron nitride as a thermally-conductive filler for preparing a heat-not-burn cigarette paper, where a raw material formula of the pulp includes the following components in parts by weight: 0.05 to 0.1 part of potassium oleate, 0.1 to 0.2 part of PVA, 5 parts of water, 15 to 2.5 parts of a softwood pulp, 50 to 70 parts of a hardwood pulp, 1 to 15 parts of boron nitride, and 20 to 50 parts of calcium carbonate.

DESCRIPTION OF THE PRINCIPLE OF THE PRESENT DISCLOSURE

A conventional cigarette paper making process typically includes the following steps: pulp preparation, sizing and papermaking, pre-drying, surface coating, post-drying, and calendering to obtain a paper. Generally, calcium carbonate is added as a filler directly to a wood pulp to adjust the whiteness and toughness of a paper.

The present disclosure divides the pulp preparation step into two stages:

(1) Potassium oleate and PVA are added to a mixed wood pulp of a softwood pulp and a hardwood pulp in the preparation of the coarse pulp. Potassium oleate serves as a surfactant to stabilize the coarse pulp. The PVA can fully expand in the subsequent heating procedure to be intercepted together with boron nitride in gaps of a pulp fiber network structure, which can reduce paper defects and enhance paper strength.

(2) Boron nitride and calcium carbonate are added to the coarse pulp for milling to obtain the pulp. Hexagonal boron nitride (BN) belongs to the hexagonal crystal system and is the most stable crystal in terms of physical and chemical properties. Moreover, with a hexagonal layered structure similar to that of graphite, the boron nitride has the characteristics of high-temperature resistance and oxidation resistance. In addition, boron nitride can be used as a cooling filler for various electrical and electronic devices, which exhibits a thermal conductivity as high as 1 W/mK to 15 W/mK and meets the engineering requirements of miniaturization and light weight. The introduction of boron nitride into the cigarette paper can greatly improve the coefficient of thermal conductivity of the cigarette paper; and as boron nitride itself has a flame-retardant effect, the stability of the cigarette paper at a high temperature (500° C.) can be greatly improved.

In a process of introducing boron nitride into the cigarette paper, it is necessary to consider the sufficient dispersion and mixing between boron nitride particles and cigarette paper fibers. Unlike the traditional process in which a filler is directly added to a pulp, the present disclosure adopts milling with a filler, that is, when boron nitride and calcium carbonate are added to a pulp, a temperature is raised to 60° C., and the agents are added under stirring, such as to realize the micro-reorganization of the boron nitride particles with the cigarette paper fiber structure. Paper fibers swell under the action of high temperature, mechanical shearing, and physical and chemical reactions, increasing the plasticity; and boron nitride can be uniformly dispersed and fully incorporated into the fibers under such process conditions to form a stable structure, thereby improving the quality control in terms of improving a coefficient of thermal conductivity of the paper fibers.

In addition, PAM is added as an additive during the surface coating in the present disclosure. Some —CONH groups in PAM molecules are hydrolyzed to produce —COOH, which produces cross-linking bonds with trivalent aluminum ions, calcium ions, and the like in a paper sheet and attaches to a surface of a paper product, making the paper product have prominent water resistance.

Compared with the prior art, the present disclosure has the following beneficial effects.

(1) Compared with an ordinary paper sheet with only calcium carbonate as a filler, the present disclosure introduces boron nitride particles as a thermally-conductive filler, which effectively improves the stability of a cigarette paper by improving a coefficient of thermal conductivity of the paper. Boron nitride has a small particle size (with an average particle size of 12 μm to 16 μm) and thus can be used as a thermally-conductive filler in a thin-walled or paper product, enabling a high heat removal capacity.

(2) Boron nitride particles are white and thus can retain the original whiteness and transparency of the cigarette paper. Boron nitride has a higher thermal conductivity than a thermally-conductive filler such as a metal oxide, and thus a load level thereof can be maintained relatively low, thereby making a product cost low.

(3) in the milling stage, the coarse pulp is heated to 60° C., and the filler is added under stirring, such as to realize the micro-reorganization of the boron nitride particles with the cigarette paper fiber structure. Paper fibers swell under the action of high temperature, mechanical shearing, and physical and chemical reactions, increasing the plasticity; and boron nitride can be uniformly dispersed and fully incorporated into the fibers under such process conditions to form a stable structure, thereby improving the quality control in terms of improving a coefficient of thermal conductivity of the paper fibers.

(4) The burning performance of the cigarette paper is adjusted, such that a burning rate of the cigarette paper is adapted to a burning rate of shredded tobacco, which is especially suitable for heat-not-burn cigarettes.

DETAILED DESCRIPTION OF THE EMBODIMENTS

The present disclosure will be further described in detail below in conjunction with specific examples. The examples enable those skilled in the art to understand the present disclosure more comprehensively, but do not limit the present disclosure in any way.

A preparation method of a heat-not-burn cigarette paper with boron nitride as a thermally-conductive filler is provided, including the following steps:

(1) preparation of a coarse pulp 0.05 to 0.1 part by weight of potassium oleate, 0.1 to 0.2 part by weight of PVA, and 5 parts by weight of water are mixed, thoroughly stirred for 30 min under an ultrasonic condition, aged for 2 hours, and filtered until there is no precipitate; and a resulting mixed solution is thoroughly, mixed with 15 to 25 parts by weight of a softwood pulp and 50 to 70 parts by weight of a hardwood pulp to obtain the coarse pulp;

(2) milling with a filler under stirring, 1 to 15 parts by weight of boron nitride and 20 to 50 parts by weight of calcium carbonate are added as a filler to the coarse pulp, and a resulting mixture is heated to 60° C. and stirred for thorough mixing to obtain a pulp for sizing and papermaking;

(3) sizing and papermaking;

(4) pre-drying;

(5) surface coating;

1 to 3 parts by weight of PAM are added as a surface coating additive in a coating machine;

(6) post-drying; and (7) calendering to obtain a paper.

The above steps (3) to (4) and (6) to (7) can be conducted according to methods and parameters of the conventional cigarette paper making process, which are not particularly limited in the present disclosure.

Relevant data of Examples 1 to 3 are shown in Table 1 (data in the table indicate the parts by weight of a corresponding component):

TABLE 1

| Example No. | 1 | 2 | 3 |
|---|---|---|---|
| Step (1): preparation of a coarse pulp | | | |
| Potassium oleate | 0.08 | 0.05 | 0.10 |
| PVA | 0.10 | 0.15 | 0.20 |
| Water | 5 | 5 | 5 |
| Softwood pulp | 22 | 25 | 15 |
| Hardwood pulp | 50 | 60 | 70 |
| Step (2): milling with a filler | | | |
| Boron nitride particles | 1 | 8 | 15 |
| Calcium carbonate filler | 50 | 32 | 20 |
| Step (6): surface coating | | | |
| PAM | 1 | 2 | 3 |

TECHNICAL EFFECT VERIFICATION

The heat-not-burn cigarette paper was baked at 300° C. for 5 min in a box-type resistance furnace, during which the degree of discoloration was observed.

TABLE 2

| | Example 1 | Example 2 | Example 3 | Control group |
|---|---|---|---|---|
| Test results of cigarette paper baked in resistance | The original color is basically retained, | The original color is basically | The original color is retained. | The cigarette paper is yellowed and brown spots |

TABLE 2-continued

| | Example 1 | Example 2 | Example 3 | Control group |
|---|---|---|---|---|
| furnace | and the cigarette paper is only slightly yellow. | retained. | | start to appear locally. |
| Thermal conductivity (W/m · K) | 0.55 | 0.76 | 0.94 | 0.33 |

A cigarette paper processing technology of the control group is different from that of Example 1 only in that no boron nitride particles are added.

The present disclosure has been described in detail herein and specific embodiments of the present disclosure are illustrated through examples in the example section. Various modifications and replacements can also be made to the present disclosure. However, it should be understood that the present disclosure is not limited to the specific forms disclosed herein. On the contrary, the present disclosure covers all modifications, equivalents, and alternatives falling within the spirit and scope of the present disclosure as defined by the appended claims.

What is claimed is:

1. A preparation method of a heat-not-burn cigarette paper with boron nitride as a thermally-conductive filler, comprising a conventional cigarette paper making process of pulp preparation, sizing and papermaking, pre-drying, surface coating, post-drying, and calendering to obtain a paper, wherein the pulp preparation specifically comprises:

(1) preparation of a coarse pulp mixing 0.05 to 0.1 part by weight of potassium oleate, 0.1 to 0.2 part by weight of polyvinyl alcohol (PVA), and 5 parts by weight of water to obtain a first mixed solution, thoroughly stirring the first mixed solution for 30 min under an ultrasonic condition, aging the first mixed solution for 2 hours, and filtering the first mixed solution until there is no precipitate; and thoroughly mixing the first mixed solution with 15 to 25 parts by weight of a softwood pulp and 50 to 70 parts by weight of a hardwood pulp to obtain the coarse pulp;

(2) milling with a filler under stirring, adding 1 to 15 parts by weight of boron nitride and 20 to 50 parts by weight of calcium carbonate as a filler to the coarse pulp to obtain a second mixed solution, heating the second mixed solution to 60° C., and stirring the second mixed solution for thorough mixing to obtain a pulp for the sizing and papermaking.

2. The method according to claim 1, wherein the surface coating refers to coating 1 to 3 parts by weight of polyacrylamide (PAM) as an additive on a surface of a cigarette paper by roller coating using a coating machine.

3. The method according to claim 1, wherein the PVA has a molecular weight ranging from 200 to 3000.

4. The method according to claim 1, wherein the boron nitride is particles having an average particle size of 12 μm to 16 μm.

5. A pulp comprising boron nitride as a thermally-conductive filler for preparing a heat-not-burn cigarette paper, wherein a raw material formula of the pulp comprises the following components in parts by weight: 0.05 to 0.1 part of potassium oleate, 0.1 to 0.2 part of PVA, 5 parts of water, 15 to 25 parts of a softwood pulp, 50 to 70 parts of a hardwood pulp, 1 to 15 parts of boron nitride, and 20 to 50 parts of calcium carbonate.

* * * * *